US005501357A

United States Patent [19]

Fullin

[11] Patent Number: 5,501,357

[45] Date of Patent: Mar. 26, 1996

[54] SEALING DEVICE FOR METALLIC CONTAINERS

[76] Inventor: Joe Fullin, 21 Knob Hill Rd., Norwalk, Conn. 06851

[21] Appl. No.: 209,728

[22] Filed: Mar. 14, 1994

[51] Int. Cl.[6] ..... B65D 45/16; B65D 45/24

[52] U.S. Cl. ..... 220/325; 220/327; 220/258

[58] Field of Search ..... 220/315, 324, 220/325, 327, 328, 258

[56] References Cited

U.S. PATENT DOCUMENTS 1,912,850 6/1933 Kuck et al. ..... 220/325 X 3,360,155 12/1967 Colonna ..... 220/325

3,800,972 4/1974 Raymond ..... 220/324 X 4,749,100 6/1988 Eberhart ..... 220/258 X

*Primary Examiner*—Allan N. Shoap

*Assistant Examiner*—Nathan Newhouse

*Attorney, Agent, or Firm*—Hoffman, Wasson & Gitler

[57] ABSTRACT

A device to be applied to the top of a metallic container after the top of the container has been completely or partially removed for the purpose of preserving the unconsumed contents of the container. The device includes a seal which is adapted to fit the contour of the top periphery of the container is sealed in place utilizing at least one locking device.

5 Claims, 4 Drawing Sheets

SEALING DEVICE FOR METALLIC CONTAINERS

BACKGROUND OF THE INVENTION

A multitude of perishable food items are sold in metallic-type cylindrical containers. These items would include various beverages, such as soda or beer or many types of fruits and vegetables. These metallic containers are generally open utilizing a "pop top" opener provided on the top surface of the container or are opened utilizing a hand or automatic can opener which removes the entire top surface of the container.

When used in the home, if the entire contents of the container is not consumed or completely used after it is opened, the unused contents can be stored in various plastic or other types of receptacles for use at a later time.

However, if one is away from home and does not consume the entire contents within the opened metallic container, the contents thereof cannot be easily stored to be used at a later time, therefore forcing the individual to discard the unused contents of the various receptacles. For example, if one is a guest at a motel, hotel or similar type of temporary lodging, and a can of soda is purchased, the contents of the can must be consumed soon after the can has been opened, or the contents must be discarded since the liquid would lose its effervescence. Similarly, hunters, campers, boaters and fishermen would also have to discard the unconsumed contents of an opened metallic food or drink container if the contents of the container are not quickly consumed.

SUMMARY OF THE INVENTION

The above deficiencies of the prior art are addressed in the present invention which is directed to a device for sealing the top of a metallic food or beverage container after the container is opened and not all of the food or beverage contained therein is consumed.

The invention contemplates covering the remaining top surface of the metallic container and the contents of the container, after a portion of the top surface or the entire top surface is removed. The invention consists of a cover to be applied to the top surface of the container, including an upstanding rim provided around the periphery of the top surface. A sealing device is molded to the underside of the cover to completely insulate the interior of the container from the outside environment to allow consummation of the contents of the container at a future time. One or more locking devices are applied to the cover to force the sealing device downward onto the rim and the remaining portion of the top surface, thereby sealing the contents of the container from the outside environment.

DETAILED DESCRIPTION OF THE PREFERRED EMBODIMENTS

Figure 1:
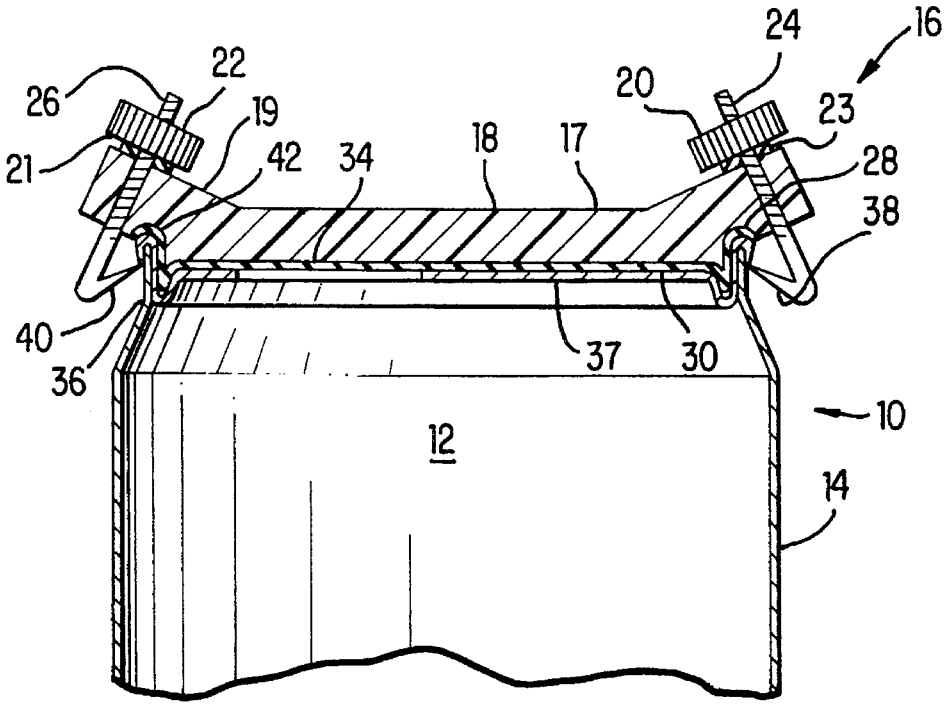
FIG. 1 is a side view of a metallic container showing the upper portion of the container and a first embodiment of the present invention.
Figure 2:
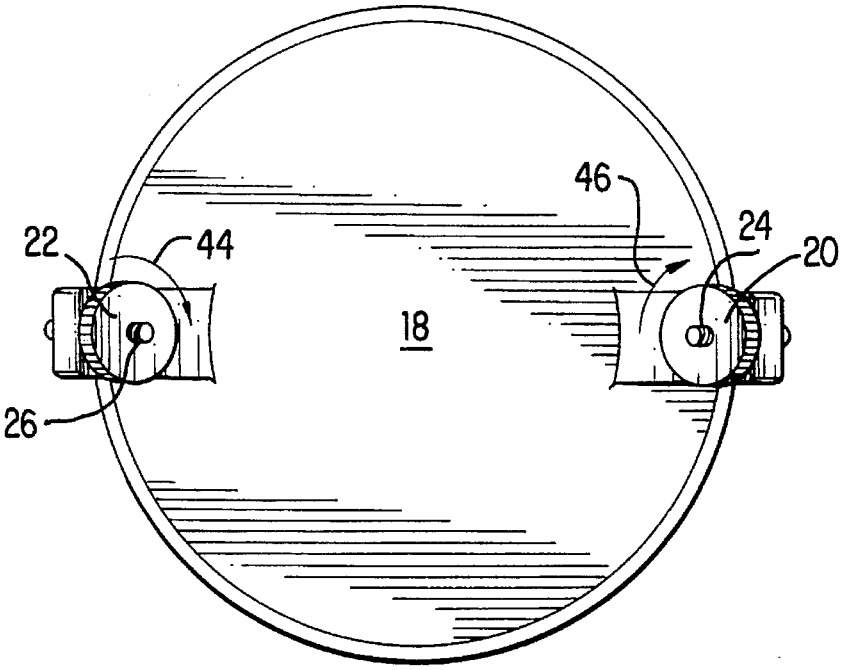
FIG. 2 is a top view of the container and seal shown in FIG. 1.
Figure 3:
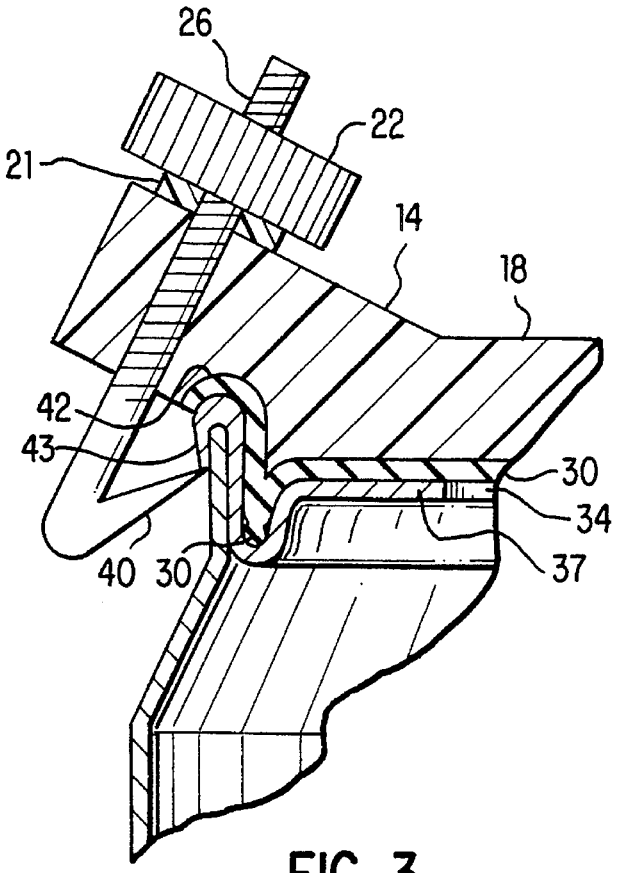
FIG. 3 is an enlarged view of a portion of the seal and container shown in FIG. 1.

The first embodiment of the present invention is illustrated with respect to FIGS. 1, 2 and 3 which shows a standard metallic type container 10 having a cylindrically shaped configuration 14 having a surface area 12 into which various perishable materials such as food and beverage are stored. The container is provided with a top surface 37 as well as a bottom surface (not shown). The top surface of a container 37 is provided with an upstanding rim 43 which encircles the entire periphery of the top of the container.

Once the contents of the container is placed therein at a factory or similar establishment, the container is sealed or packed to preserve freshness and to avoid contamination of the contents. After the container is purchased, it can be opened by a standard tab-like device generally utilized with beer or soda containers, the tab-like device affixed to the top surface 37 of the container leaving an access opening 34. Similarly, the container can be opened by removing the entire top surface 37 employing a hand-operated or automatic can opener. It is important to note that the present invention can operate to seal the contents of a metallic container regardless of whether a portion of the top surface of the container is opened, or the entire top surface of the container is removed, as long as the rim 43 encircling the periphery of the top surface 37 remains.

As particularly shown in FIGS. 1 and 3, the contents of the metallic container can be reserved for later use employing a sealing device 16. This sealing device includes a hardened metallic or plastic molded cover 18 which is designed to overlay the entire top surface of the metallic container regardless of whether only a portion of the top surface of the container 37 is removed leaving a partial opening 34 or the entire top surface of the container 37 is removed. This covering device 18 is provided with a flat middle portion 17 as well as an angled periphery portion 19 which covers the outer surface area of the opened container or the non-removed portion of the container top 37 as well as the rim 43.

The upwardly angled portion 19 of the cover 18 is provided with two holes which extend from the top of the upwardly angled portion 19 to the bottom thereof. When used with relatively small metallic containers, these two holes are included on diametrically opposed portions of the section 19. In this example, each of the holes is provided with a vertical threaded shaft 24, 26 constructed from steel or a similar material. The shaft 24 is provided with a hook 38 on one end angled with respect to the shaft. Similarly, shaft 26 is provided with a hook member 40.

Plastic or metallic threaded nuts 20, 22 are adapted to be used with respect to threaded shafts 24, 26 to tighten the cover 18 in the direction shown by arrows 44, 46 shown in FIG. 2, to seal the contents of the metallic can. Standard washers 21, 23 are included between the nuts 22, 20 and the angled portion 19. The leading edge of each of the hooks is fairly sharp in order to "dig in" to the rim of the container 43 or the side 14 of the container 12 when the nuts 20, 22 are tightened. The contour of each of the hooks is the same radius as that of the container so that there is no slippage and a tight fit is provided at the underside of the rim of the container. The rim of the container 43 as well as the center line of the vertical threaded shaft are exactly parallel to one another to guide the hook portion into its correct position to hook into the bottom of the rim to assure a direct and proper lock onto the rim of the container in order to force the cover 18 directly into the profile of the top of the container and the top of the rim 43, thereby causing a proper and direct leak-proof seal, preserving the contents of the container for future use.

A plastic seal 30 having an O-ring contour (shown at 36) is directly molded to the underside of the cover 18. This seal is provided with exactly the same contour as the top portion of the container. Since the majority of containers provided with food and beverages therein are manufactured in several standard sizes, it can be appreciated that the cover 18 as well as the seal 30 can also be manufactured in these standard sizes so that the container is properly sealed. Additionally, it is noted that the seal 30 is provided with a rim 42 which is adapted to fit over a portion of the rim 43 of the container. It is important to note that this rim 42 can be manufactured to fit over the entire portion of the rim 43 as shown by 28, or a portion of the rim 43.

Although the first embodiment of the present invention as illustrated in FIGS. 1, 2 and 3 describe the use of two threaded shafts and two nuts, it can be appreciated that additional locking devices can be utilized for larger containers, with the locking devices evenly spaced around the periphery of the container.

Figure 4:
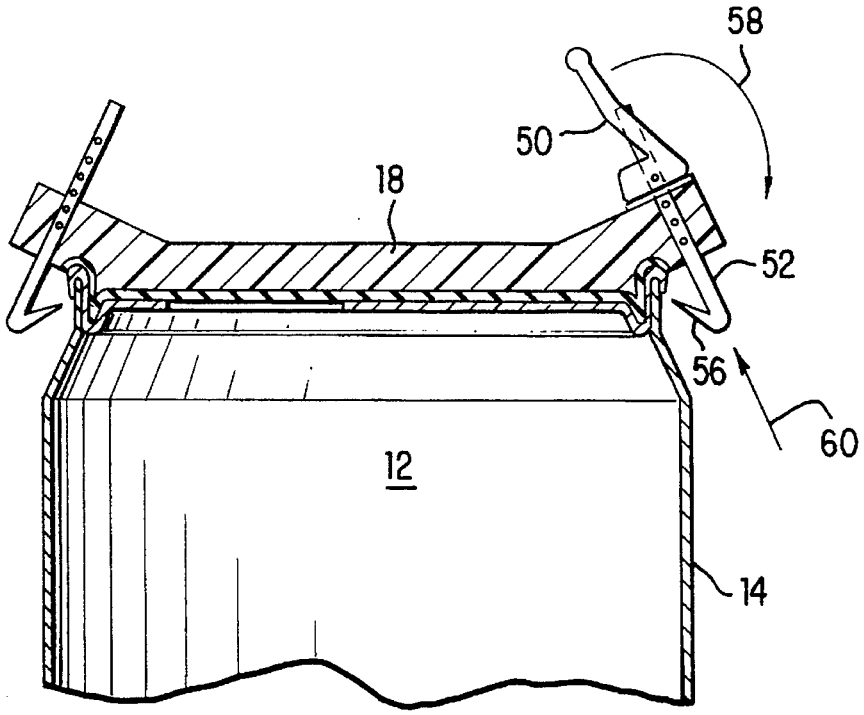
FIG. 4 is a side view of the metallic container showing a second embodiment of the present invention.
Figure 5:
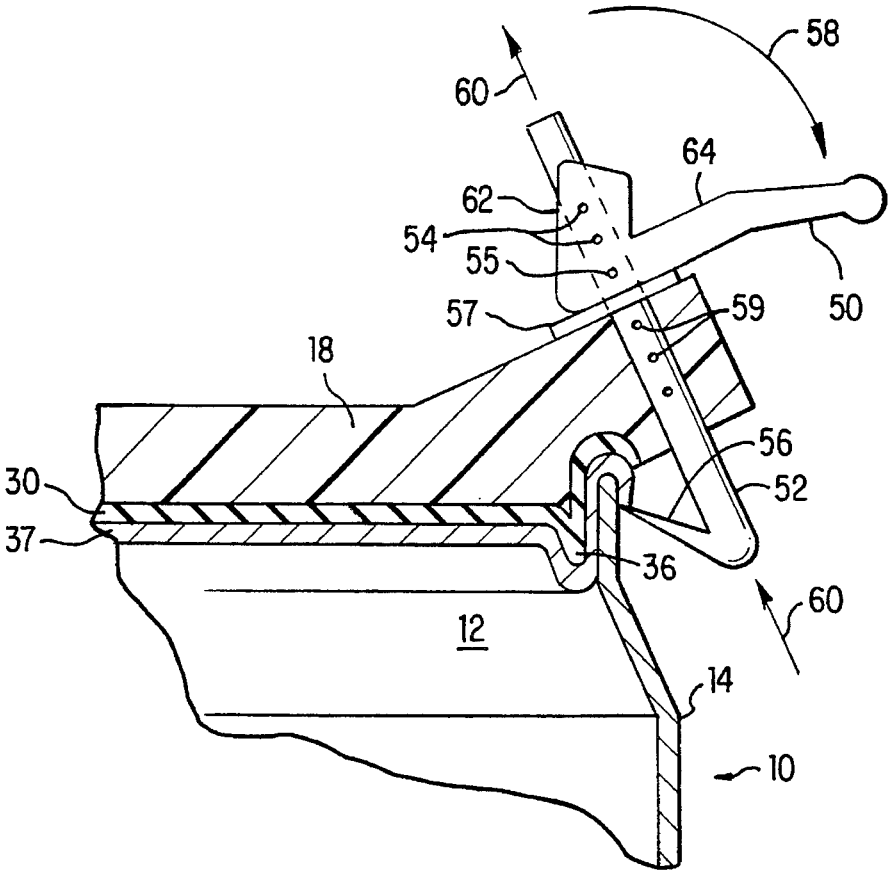
FIG. 5 is an enlarged view of the invention shown in FIG. 4.

A second embodiment of the present invention is illustrated with respect to FIGS. 4 and 5 with like elements maintaining their respective reference numerals. This embodiment employs an over-center toggle device 50 instead of the threaded shaft and nut securing device described with respect to FIGS. 1, 2 and 3. This toggle device is provided with a base portion 62 as well as a handle portion 64. A non-threaded vertical shaft portion 52 provided with a hook member 56 in a manner similar to the embodiment shown in FIGS. 1, 2 and 3 is provided with a plurality of holes 59 and is inserted into the angled portion 19 of the cover 18. An axis pin 55 is inserted into one of the holes 54 provided in the bottom portion 62 of the toggle 50 and through one of the holes 59 provided in the shaft 52. One or more thin washers 57 can be used as spacers, if necessary, to adjust the locking device to tighten the cover 18 and seal 30 against the rim of the container. As illustrated in FIG. 5, when the handle portion 64 is forced downward as shown by the arrow 58, the vertical shaft 52 is forced upward as shown by arrows 60 to allow the hook portion 56 to "dig into" the rim or side of the container.

As was true with respect to the first embodiment, two or more equally spaced locking devices can be provided around the periphery of the cover, based upon the size of the container.

Figure 6:
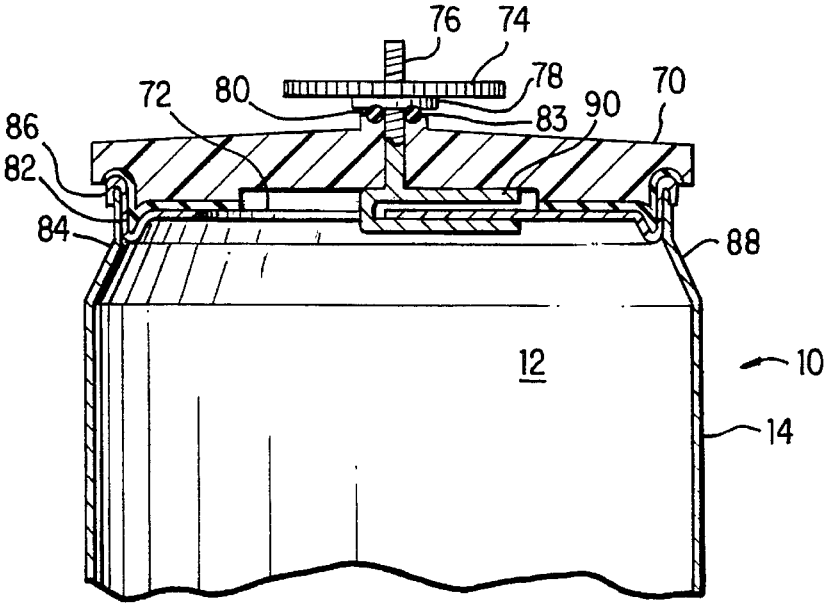
FIG. 6 is a side view of the metallic container and a third embodiment of the present invention.

A third embodiment of the present invention is illustrated in FIG. 6. This embodiment employs a single threaded shaft 76 which is inserted through a cover member 70 adapted to cover the entire top surface of the container 10. This cover unit is a hardened metallic or plastic molded unit having a plastic-type seal 82 molded to the bottom surface thereof. It is noted that this cover unit 70 is provided with a relatively flat top surface which slants slightly downward from the middle of the cover 70 to its periphery. The threaded shaft 76 is inserted through the center of the cover 70 and is provided with two U-shaped fingers 88, 90 which surround the top surface 84 of the container 10. In this embodiment, the container 10 is opened by a tab-like device leaving a partially uncovered portion 72. The shaft 76 is partially threaded from its top and a split plastic washer 78 acts as a keeper for an O-ring 80. Rotation of a nut 74 would force the vertical shaft 76 downward at the same time the O-ring 80 is tightened around the shaft, producing a proper seal. Indentations 83 are provided in the center of the top surface of the cover 70 to properly seat O-ring 86. Similar to the seals shown in the previous embodiments, a plastic-like seal 82 is molded to the bottom of the cover 70. This seal, similar to the earlier embodiments, would be forced downward around of the rim of the container. This seal is designed to exactly fit the profile of the container so that it seals the entire top of the container and the rim. The U-shaped fingers 88, 90 forming a fork between the top of the container 84 is offset to allow the vertical position to be at the center line of the container since the opening 72 is offset slightly from the center line of the container.

Figure 7A:
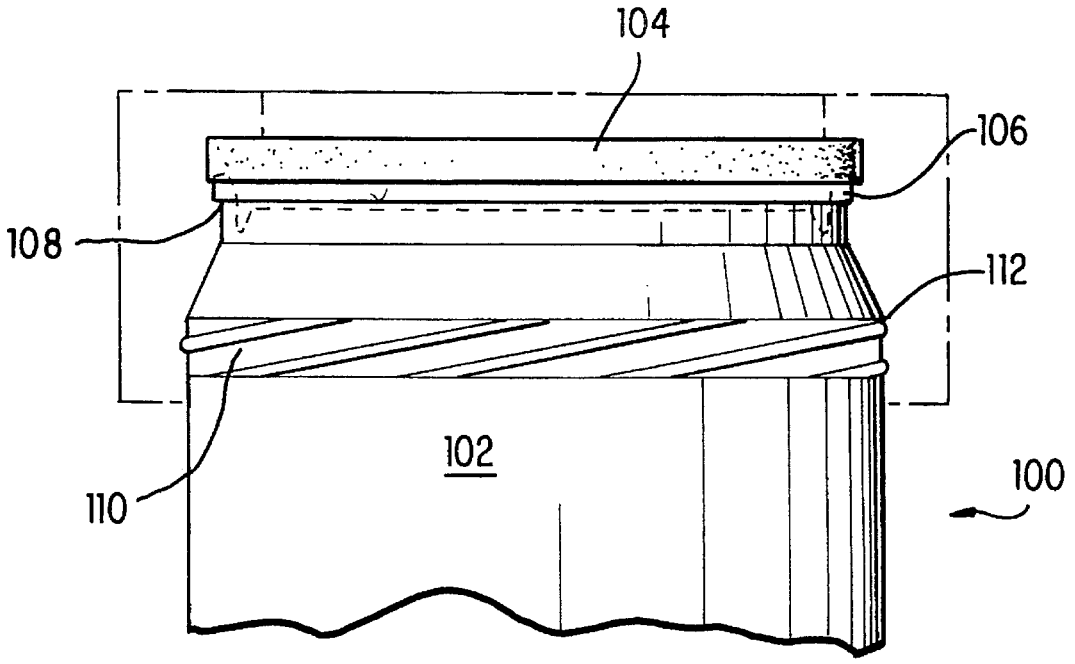
FIG. 7A is a side view of the metallic container showing a fourth embodiment of the present invention.
Figure 7B:
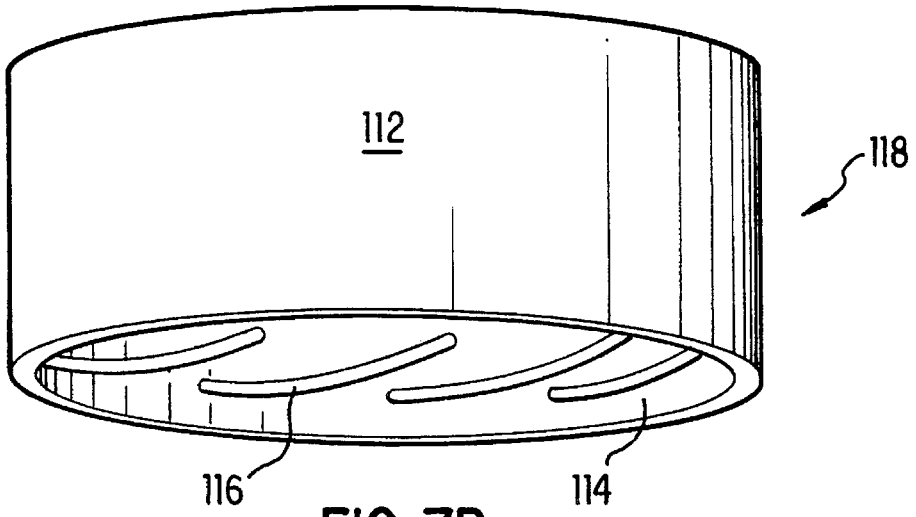
FIG. 7B is a perspective view of the sealing member encompassing the fourth embodiment of the present invention.

A fourth embodiment of the present invention is illustrated with respect to FIGS. 7A and 7B. In this embodiment, a container 100 having an exterior surface 102 is provided with a plurality of external threads 110, the threads provided slightly below the ridge line 112 of the container, for strength. Once the top of the container is entirely removed or a portion of the top of the can is removed, a molded cover 104 having a bottom seal portion 106 directly molded to the bottom of the cover 104 in a manner similar to the seal shown in the first three embodiments of the present invention, is placed over the rim 108 surrounding the periphery of the top of the container. This seal is locked in place by a cylindrically shaped cap 118 having an exterior surface 112 and an interior surface 114. Threads 116 are affixed to the interior surface 114 of the sealing cap 118 and are adapted to cooperate with the threads 110 affixed to the exterior surface 102 of the container 100. Although it is not shown in FIG. 7B, a solid surface is provided at the top of the cap 118. Once this cap 118 is screwed onto the top of the container 100, the seal 106 of the cover 104 would be forced against the rim 108 of the container 100 to preserve the unused contents of the container 100. Alternatively, it is noted that the cover 104 along with the seal portion 106 can be built into the top of the cap 118.

Although the present invention has been described with reference to the specific details of certain embodiments, it is not intended that such details should be regarded as limitations upon the scope of the invention except that and to the extent that they are included in the accompanying claims.

What is claimed is:

1. A device for sealing the contents of a previously opened container from the environment, the container provided with a top surface, having at least a portion removed therefrom, the top surface of the container surrounded by a rim, comprising:

a cover;

a sealing device attached to the underside of said cover, said sealing device contoured to the profile of the top surface of the container and adapted to overlie the rim and any remaining portion of the top surface; said cover configured to overlay the top surface of said container, said cover further including a middle portion, and a peripheral portion, said middle portion being flat and said peripheral portion being slanted from said middle portion; and locking means for tightly securing said sealing device to the rim and any remaining portion of the top surface, to isolate the contents of the container to the outside environment, whereby said peripheral portion covers the outer surface area of said previously opened or the non-removed portion of the container top or said rim.

2. The device in accordance with claim 1, wherein said locking means comprises a shaft inserted through said cover, said shaft provided with a distal end having an upturned hook portion, and a means for applying pressure to said cover forcing said upturned hook to abut or slightly penetrate the rim of the container.

3. The device in accordance with claim 2, wherein said shaft is threaded and said means for applying pressure is a threaded nut.

4. The device in accordance with claim 2, when a plurality of locking means are disposed around the periphery of said cover.

5. The device in accordance with claim 2, wherein said shaft has at least one hole therein and said means for applying pressure is an over-center toggle having a handle portion and a base portion, said base portion provided with at least one hole, said over-center toggle attached to said shaft with a pivot pin through respective holes in said over-center toggle and said shaft.

* * * * *